US006176793B1

(12) United States Patent
Sullivan et al.

(10) Patent No.: US 6,176,793 B1
(45) Date of Patent: Jan. 23, 2001

(54) GOLF BALL WITH CONTOURED DIMPLES

(75) Inventors: Michael J. Sullivan, Chicopee, MA (US); Terence Melvin, Ormond Beach, FL (US)

(73) Assignee: Spalding Sports Worldwide, Inc., Chicopee, MA (US)

( * ) Notice: Under 35 U.S.C. 154(b), the term of this patent shall be extended for 0 days.

(21) Appl. No.: 09/259,673

(22) Filed: Mar. 1, 1999

(51) Int. Cl.[7] ..... A63B 37/12; A63B 37/14

(52) U.S. Cl. ..... 473/378; 473/351; 473/378; 473/383; 473/384

(58) Field of Search ..... 473/351, 378, 473/383, 384

(56) References Cited

U.S. PATENT DOCUMENTS

| | | | | |
|---|---|---|---|---|
| 4,681,323 | * | 7/1987 | Alaki et al. | 273/232 |
| 5,005,838 | | 4/1991 | Oka . | |
| 5,174,578 | * | 12/1992 | Oka et al. | 273/232 |
| 5,338,039 | * | 8/1994 | Oka et al. | 273/232 |
| 5,377,989 | * | 1/1995 | Machin | 273/232 |
| 5,467,994 | * | 11/1995 | Moriyama et al. | 273/222 |
| 5,503,398 | | 4/1996 | Lu . | |
| 5,722,903 | * | 3/1998 | Moriyama et al. | 473/384 |
| 5,735,757 | * | 4/1998 | Moriyama et al. | 473/384 |
| 5,772,532 | * | 6/1998 | Stiefel et al. | 473/384 |
| 5,800,287 | * | 9/1998 | Yokota et al. | 473/372 |
| 5,820,492 | * | 10/1998 | Yamagishi et al. | 473/377 |
| 5,836,832 | * | 11/1998 | Boehm et al. | 473/354 |
| 5,857,924 | * | 1/1999 | Miyagawa et al. | 473/365 |
| 5,890,975 | * | 4/1999 | Stiefel | 473/374 |

FOREIGN PATENT DOCUMENTS 2327890 2/1999 (GB) .

* cited by examiner

*Primary Examiner*—Stephen F. Gerrity
*Assistant Examiner*—Paul Kim
(74) *Attorney, Agent, or Firm*—Laubscher & Laubscher

(57) ABSTRACT

A new configuration for dimples on the surface of a golf ball is characterized by at least a portion of the bottom surface of the dimple having a raised contour which is still below the surface of the ball. The contoured portion may comprise many shapes including a crescent or a sinusoidal configuration. Moreover, the contoured portion may have different portions having different depths. The contours within at least some of the dimples on the surface of the ball alter the air flow across the golf ball surface to reduce drag and increase the distance the ball will travel.

16 Claims, 3 Drawing Sheets

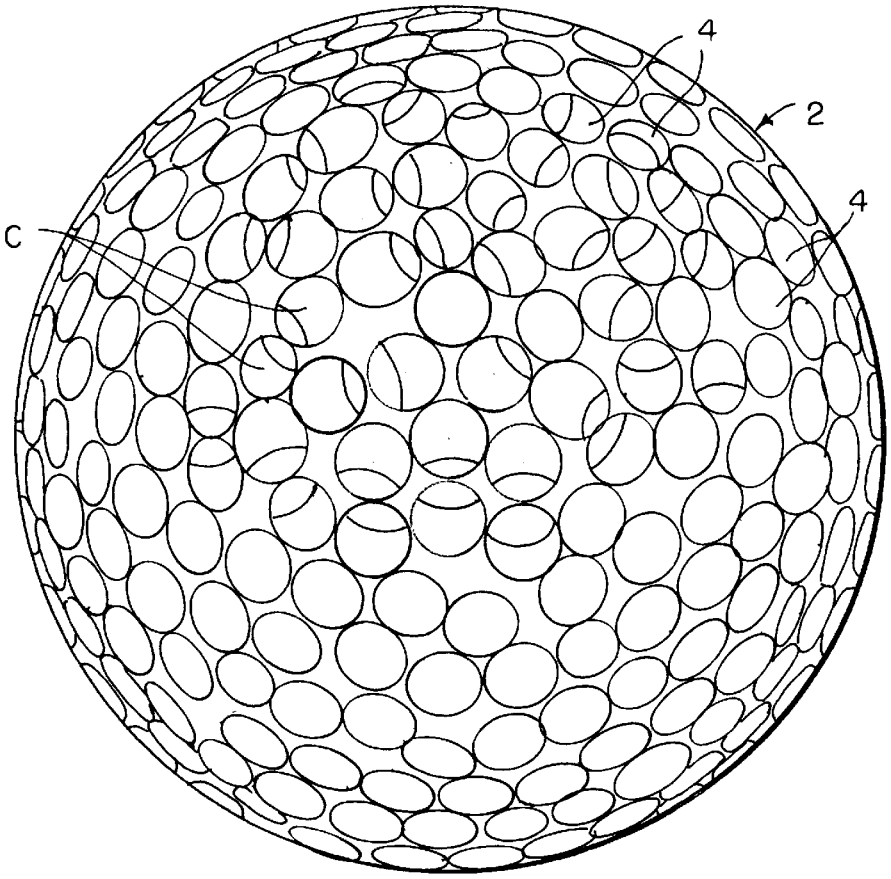
FIG. 1
FIG. 2
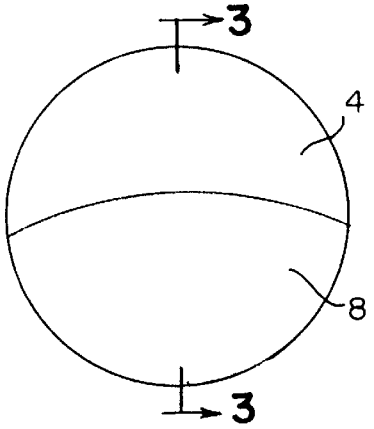
FIG. 3
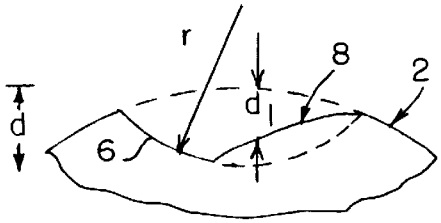

GOLF BALL WITH CONTOURED DIMPLES

BACKGROUND OF THE INVENTION

The present invention relates to a new configuration for the dimples on a golf ball surface which improve the flight characteristics of the ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Numerous dimple configurations for use on golf balls are well-known in the patented prior art, including contoured dimples. For example, the Lu U.S. Pat. No. 5,503,398 discloses a golf ball having a plurality of dimples arranged on the spherical outer surface thereof, each of the dimples including a series of overlapping scales extending inwardly on an arcuate shaped sidewall surface of the dimple. The ball has improved directional control and increased lift and flight distance. The Oka U.S. Pat. No. 5,005,838 discloses a golf ball having a plurality of dimples in its outer surface. Each of the dimples includes a circular projection positioned in a bottom portion thereof. The projections are alleged to increase the coefficient of drag as the ball passes through the air, thereby decreasing the distance the ball will travel.

As opposed to the Oka golf ball, the present invention was developed in order to provide a golf ball with reduced drag so that the ball will travel a greater distance than conventional golf balls having circular dimples.

SUMMARY OF THE INVENTION

Accordingly, it is a primary object of the present invention to provide a golf ball having a spherical surface including a plurality of dimples arranged in the surface. The dimples are concavities in the ball surface at least some of which are modified so that part of the dimple surface is convex with respect to the dimple concave surface. Thus, these dimples have a raised contoured surface relative to the dimple bottom, with the contoured surface remaining below the surface of the ball.

According to another object of the invention, the contoured portion has a crescent configuration relative to the bottom surface. The contoured portion may comprise portions of different depths. The depth of a dimple at any point is the distance between the original undimpled ball surface and that point measured along a ball radius. In one embodiment the contoured portion includes a spaced pair of first portions having a first depth and a second portion arranged between the first portions and having a second depth different from the first depth. The contoured portion may also cover the entire bottom surface of the dimple.

According to a further embodiment, the contoured portion of at least one dimple is arranged adjacent to the contoured portion of an adjacent dimple.

BRIEF DESCRIPTION OF THE FIGURES

These and other objects according to the invention will become apparent from a study of the following specification when viewed in the light of the accompanying drawing, in which:

FIG. 1 is plan view of a golf ball including a plurality of contoured circular dimples according to the invention;

FIGS. 2 and 3 are plan and sectional views, respectively, of a contoured dimple according to a first embodiment of the invention;

DETAILED DESCRIPTION

Figure 4:
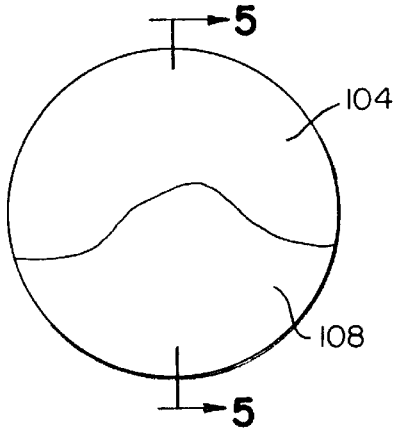
FIGS. 4 and 5 are plan and sectional views, respectively, of a contoured dimple according to a second embodiment of the invention.

In FIG. 1, there is shown a golf ball 2 having a spherical surface which contains a plurality of circular dimples 4, the circle being defined where the dimple intersects with the surface of the ball. The dimples may all be of the same diameter, or different diameter dimples may be provided. As shown in FIG. 3, each dimple has a bottom surface 6 defined by a radius of curvature r for the dimple. The radius further defines the depth d of each dimple.

At least some of the dimples on the golf ball surface include a contoured portion 8 on the bottom surface. The contour—which is analogous to a filled-in portion of the dimple—can take many different shapes, examples of which will be described in the embodiments of FIGS. 2–9. The contoured portion has a depth less than the radius of curvature of the dimple. Thus, each contoured dimple includes a raised contoured portion relative to the dimple bottom, with the contoured portion being maintained below the surface of the golf ball. Thus, the ball diameter is not increased by the contoured portions. In order to comply with U.S.G.A. regulations, the ball 2 has an outer diameter of at least 1.680 inches.

A first contoured dimple configuration is shown in FIGS. 2 and 3. The circular dimple has a crescent shaped contoured portion 8. This portion has a depth d1 less than the depth d of the dimple 4. The depth of a dimple at any point is the distance between the original undimpled ball surface and that point measured along a ball radius. The width of the crescent is preferably in the vicinity of one-half the diameter of the dimple, but other widths may be provided as well.

Figure 5:
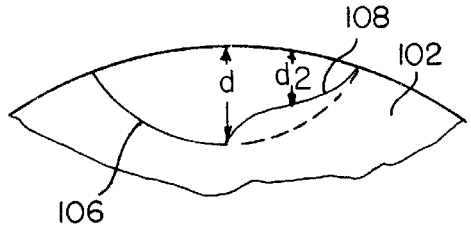

In the second embodiment shown in FIGS. 4 and 5, the dimple 104 in a golf ball 102 has a bottom surface 106 with a sinusoidal contoured portion 108. As with the crescent-shaped contoured portion of the embodiment of FIGS. 2 and 3, the sinusoidal contoured portion 108 has a depth d2 less than the depth d of the dimple 104.

Figure 6:
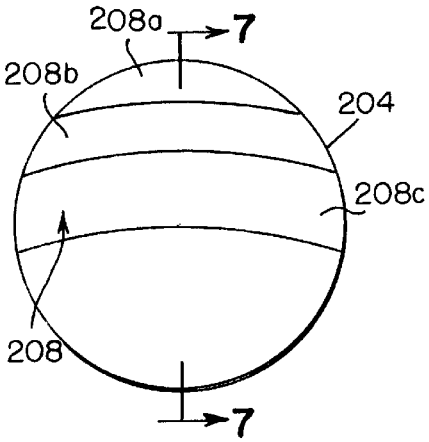
FIGS. 6 and 7 are plan and sectional views, respectively, of a contoured dimple according to a third embodiment of the invention.
Figure 7:
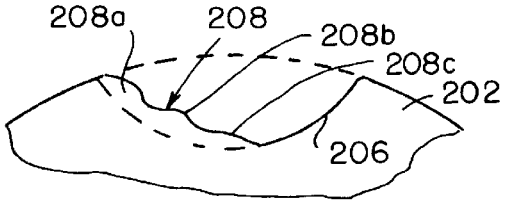

A third embodiment for a contoured circular dimple 204 in a golf ball 202 is shown in FIGS. 6 and 7 wherein the contoured portion 208 in the dimple bottom surface 206 includes generally parallel portions 208*a*, 208*b*, 208*c* having different depths all of which are less than the total depth of the dimple. As shown particularly in FIG. 7, the portions 208*a*, 208*b*, and 208*c* define a stairstep configuration within the dimple.

Figure 8:
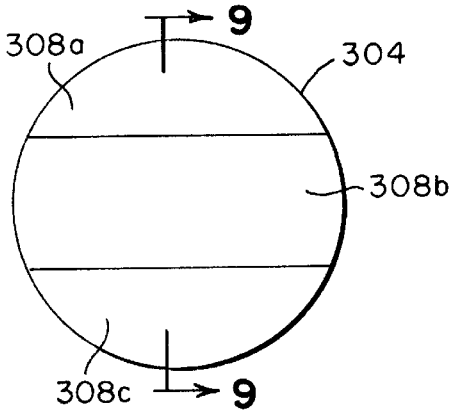
FIGS. 8 and 9 are plan and sectional views, respectively, of a contoured dimple according to a fourth embodiment of the invention.
Figure 9:
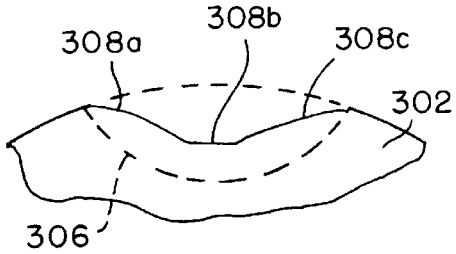

In the fourth embodiment shown in FIGS. 8 and 9, the contoured portion 308 covers the entire original bottom surface of the dimple 306 of the dimple 304 in a golf ball 302. Moreover, the contoured portion comprises portions of different depths. Preferably, the contoured portion includes a first portion 308*a* having a first depth, a second portion 308*b* having a second depth and a third portion 308*c* having a depth equal to that of the first portion as shown in FIG. 9. Thus the second portion 308*b* is preferably arranged between the first and third portions and has a depth greater than the first depth.

Figure 10:
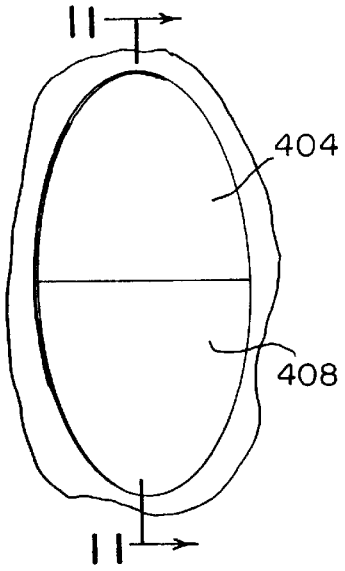
FIGS. 10 and 11 are plan and sectional views, respectively, of a non-circular oval dimple according to a fifth embodiment of the invention.
Figure 11:
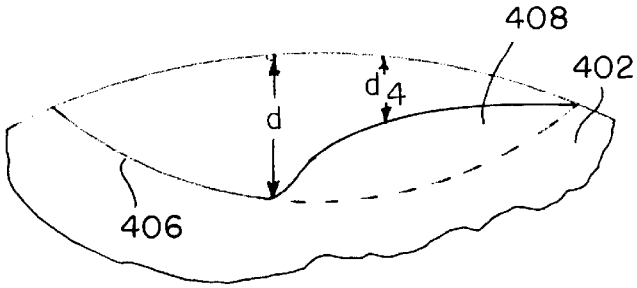

In FIGS. 10 and 11 is shown the fifth embodiment of the invention wherein the dimple 404 in a golf ball 402 has an oval configuration. The contoured portion 408 of the dimple bottom surface 106 has a depth d4 less than the depth d of the dimple.

Figure 12:
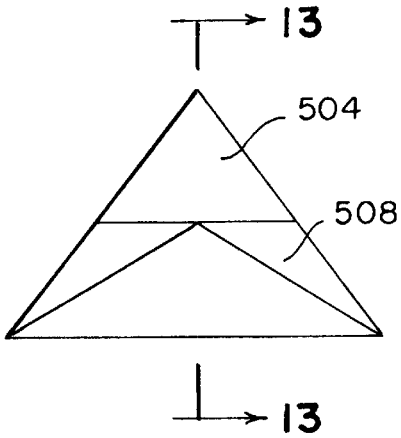
FIGS. 12 and 13 are plan and sectional views of a triangular dimple according to a sixth embodiment of the invention.
Figure 13:
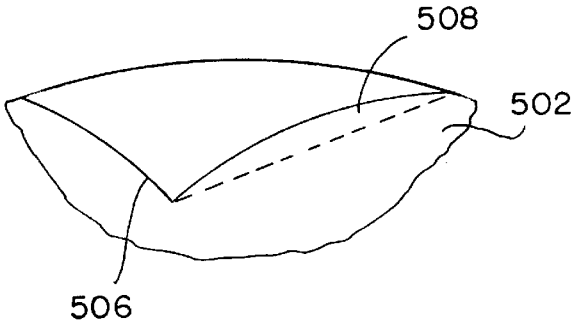

A sixth embodiment of the invention is shown in FIGS. 12 and 13 wherein the dimple 504 in a golf ball 502 has a triangular configuration, as does the contoured portion 508 of the dimple bottom surface 506.

Referring once again to FIG. 1, at least some of the contoured dimples C are arranged so that the contoured portions of adjacent dimples are also arranged adjacent one another. If desired, all of the contoured dimples can be paired with an adjacent dimple with the contoured portions adjacent. It will be appreciated that all of the dimples on the golf ball surface may be provided with contoured portions. Moreover, the dimples can be arranged on the golf ball surface in a random or geometric pattern. Any combination of contoured and non-contoured dimples may be provided.

In all of the embodiments, the contoured portion within the dimple significantly alters the air flow across the surface of the ball as it travels through the air when struck by a golf club. The altered air flow serves to decrease the drag on the ball, thereby increasing the distance that it will travel.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. A dimple arranged in a spherical surface of a golf ball, comprising a concavity in the ball surface in which at least a portion of said concavity is modified so that a portion of the dimple surface is convex and non-symmetric with respect to a surface defining the concavity, thereby to define a non-symmetrical contoured portion of the dimple, said contoured portion being maintained below the surface of the ball.

2. A dimple as defined in claim 1, wherein said contoured portion has a sinusoidal configuration relative to the bottom surface.

3. A dimple as defined in claim 1, wherein said contoured portion has a crescent configuration relative to the bottom surface.

4. A dimple as defined in claim 3, wherein said contoured portion includes portions having different depths.

5. A dimple as defined in claim 1, wherein said dimple has a circular configuration.

6. A dimple as defined in claim 1, wherein said dimple has an oval configuration.

7. A dimple as defined in claim 1, wherein said dimple has a triangular configuration.

8. A golf ball having a spherical surface containing a plurality of dimples, each of said dimples comprising an outer edge at the intersection with the spherical surface and a concavity in the ball surface in which at least a portion of said concavity is modified so that a portion of the dimple surface is convex and non-symmetric with respect to a surface defining the concavity, thereby to define a non-symmetrical contoured portion of the dimple, said contoured portion being maintained below the surface of the ball.

9. A golf ball as defined in claim 8, wherein said contoured portion has a crescent configuration relative to the bottom surface.

10. A golf ball as defined in claim 9, wherein said contoured portion of at least one dimple is arranged adjacent to said contoured portion of an adjacent dimple.

11. A golf ball as defined in claim 9, wherein said contoured portion includes portions having different depths.

12. A golf ball as defined in claim 8, wherein said contoured portion has a sinusoidal configuration relative to the bottom surface.

13. A golf ball as defined in claim 8, wherein at least one of said dimples has a circular configuration.

14. A golf ball as defined in claim 8, wherein at least one of said dimples has an oval configuration.

15. A golf ball as defined in claim 8, wherein at least one of said dimples has a triangular configuration.

16. A dimple arranged in a spherical surface of a golf ball, comprising (a) a depression in the ball surface, said depression having a bottom surface having a geometrical configuration and a center;

(b) a raised contour portion arranged on at least a portion of said depression bottom surface, said contour portion defining at least a portion of the bottom surface of the dimple, said contour portion being maintained below the surface of the ball, said contour portion being non-symmetric with respect to said bottom surface in cross-section in a plane containing the center of said depression and a center of the ball.

* * * * *